US012559827B2

(12) United States Patent
Schirm et al.

(10) Patent No.: US 12,559,827 B2
(45) Date of Patent: Feb. 24, 2026

(54) PROCESSES FOR MAKING METAL RINGS FORMED FROM BERYLLIUM-COPPER ALLOYS

(71) Applicant: MATERION CORPORATION, Mayfield Heights, OH (US)

(72) Inventors: Jeffrey M. Schirm, Perrysburg, OH (US); Christopher W. Damschroder, Elmore, OH (US); Edward B. Longenberger, Perrysburg, OH (US); Jeffrey A. McBride, Luckey, OH (US)

(73) Assignee: MATERION CORPORATION, Mayfield Heights, OH (US)

( * ) Notice: Subject to any disclaimer, the term of this patent is extended or adjusted under 35 U.S.C. 154(b) by 455 days.

(21) Appl. No.: 18/157,539

(22) Filed: Jan. 20, 2023

(65) Prior Publication Data

US 2023/0151474 A1 May 18, 2023

Related U.S. Application Data

(62) Division of application No. 16/762,175, filed as application No. PCT/US2018/061524 on Nov. 16, 2018, now abandoned.

(Continued)

(51) Int. Cl.
*C22F 1/08* (2006.01)
*B21K 1/76* (2006.01)

(Continued)

(52) U.S. Cl.
CPC ..... *C22F 1/08* (2013.01); *B21K 1/761* (2013.01); *C22C 9/00* (2013.01); *C22F 1/002* (2013.01)

(58) Field of Classification Search
CPC . C22F 1/08; C22F 1/002; B21K 1/761; C22C 9/00; F16C 2220/44; F16C 2300/14; C21D 9/40
See application file for complete search history.

(56) References Cited

U.S. PATENT DOCUMENTS 4,179,314 A 12/1979 Wikle
4,425,168 A 1/1984 Goldstein et al.
(Continued)

FOREIGN PATENT DOCUMENTS

CN 1188436 A 7/1998
CN 101981211 A 2/2011
(Continued)

OTHER PUBLICATIONS

CN-103436829-A, machine translation. (Year: 2013).*
(Continued)

*Primary Examiner* — John A Hevey
(74) *Attorney, Agent, or Firm* — COZEN O'CONNOR

(57) ABSTRACT

Processes are disclosed for forming beryllium-copper metal rings having a fine and uniform grain structure. A raw BeCu casting is pre-forged and turned to form a BeCu billet. The BeCu billet is subjected to various heat treatment and cooling cycles to obtain/maintain combinations of advantageous material properties. Generally, the BeCu billet is preheated, hot worked via forging, heated again, hot worked again via ring rolling followed by air cooling, solution annealed followed by quenching, and heated a final time followed by air cooling.

19 Claims, 4 Drawing Sheets

Related U.S. Application Data

(60) Provisional application No. 62/587,533, filed on Nov. 17, 2017.

(51) Int. Cl.
*C22C 9/00* (2006.01)
*C22F 1/00* (2006.01)

(56) References Cited

U.S. PATENT DOCUMENTS

| | | | | |
|---|---|---|---|---|
| 4,579,603 | A | 4/1986 | Woodard et al. | |
| 4,792,365 | A | 12/1988 | Matsui et al. | |
| 5,354,388 | A | 10/1994 | Nojiri et al. | |
| 5,564,490 | A | 10/1996 | Liebermann et al. | |
| 5,651,844 | A * | 7/1997 | Longenberger | C22F 1/08 148/683 |
| 5,842,511 | A * | 12/1998 | Raybould | B22D 11/0648 164/429 |
| 7,510,615 | B2 | 3/2009 | Rode et al. | |
| 2004/0112566 | A1 * | 6/2004 | Myojin | C22F 1/00 164/463 |
| 2004/0216817 | A1 | 11/2004 | Harkness | |
| 2010/0006191 | A1 | 1/2010 | Wetzel et al. | |

FOREIGN PATENT DOCUMENTS

| | | | |
|---|---|---|---|
| CN | 102212712 | A | 10/2011 |
| CN | 102383078 | A | 3/2012 |
| CN | 102876918 | A | 1/2013 |
| CN | 103100715 | A | 5/2013 |
| CN | 103436829 | A * | 12/2013 |
| CN | 104769139 | A | 7/2015 |
| EP | 0854200 | A1 | 7/1998 |
| RU | 2168084 | C2 | 5/2001 |
| WO | 2014/069303 | A1 | 5/2014 |

OTHER PUBLICATIONS

Anonymous, "Guide to High Performance Alloys", (Jan. 1, 2012), p. FP-82, Lamineries Matthey SA, Retrieved from the Internet: URL:www.matthey.ch/fileadmin/user_upload/brochure/Guide)_To_HP_Alloys.pdf XP055307616 [retrieved on Oct. 4, 2016].

Zheleznyak et al., "Nontraditional Technological Processes Mechanical Properties and Structure of Rolled Rings From Beryllium Bronze BrB2", (Oct. 1, 1999), pp. 454-456 Retrieved from the Internet: URL:https:/link.springer.com/content/pdf/10.1007/BF02469098.pdf XP055579265 [retrieved on Apr. 9, 2019].

Anonymous, "Characteristics for grade BrB2", Database of Steel and Alloy (Marochnik) Retrieved from the Internet: URL:http://www.splav-kharkov.com/en/e_mat_start.php?name_id=1086#1 XP002790529 [retrieved on Apr. 11, 2019].

Harness, et al., "Beryllium-Copper And Other Beryllium-Containing Alloys", "Properties And Selection : Nonferrous Alloys and Special Purpose Materials", pp. 403-423, (Jan. 1, 1990), ASM International, ASM, US, XP002045188 ISBN: 9781627081627.

Arthington, et al., Curvature control in radial-axial ring rolling, I FAC-PapersOn Line, vol. 49, Issue 20, 2016, pp. 244-249. (Year: 2016).

* cited by examiner

PROCESSES FOR MAKING METAL RINGS FORMED FROM BERYLLIUM-COPPER ALLOYS

CROSS-REFERENCE TO RELATED APPLICATIONS

This application is a division of U.S. application Ser. No. 16/762,175, filed on May 7, 2020, which is a 371 of PCT/US2018/061524 filed Nov. 16, 2018, which claims priority to U.S. Provisional Patent Application Ser. No. 62/587,533, filed Nov. 17, 2017, the contents of which are fully incorporated by reference herein.

BACKGROUND

The present disclosure relates to metal rims or rings that are used for casting amorphous metals. In particular, the rings of the present disclosure are made from beryllium-copper alloys. Processes for making the same are disclosed, and will be described with particular reference thereto.

Beryllium-copper ("BeCu") alloys are notable for their superior combination of thermal conductivity, strength, toughness, impact energy and resistance to corrosion. Additional benefits of BeCu alloys include a relatively high electrical conductivity, ultrasonic inspectability and good thermal management. This combination of properties has made BeCu alloys desirable for a wide range of applications. However, more economical processing of BeCu alloys is sought.

Conventional metal rings have experienced problems related to surface quality longevity, ductility, formability, ultrasonic inspectability, conductivity, and lack of grain size refinement. The metal rings disclosed herein address these issues while easing product manufacture and reducing costs.

BRIEF DESCRIPTION

The present disclosure relates to BeCu metal rings having a fine and uniform grain structure as well as processes for forming the same. A raw BeCu casting is pre-forged and turned to form a BeCu billet. In general, heat treatment and cooling cycles are performed to achieve material properties which permit the rings to maintain surface quality for long periods of time, while at the same time enabling customers to gain higher productivity from each casting ring. Very broadly, the BeCu billet is preheated, hot worked via forging, heated again, hot worked again via ring rolling followed by air cooling, solution annealed followed by quenching, and heated a final time followed by air cooling.

Disclosed in various embodiments herein are processes for making metal rings which include providing a billet made from a BeCu alloy. The billet is preheated at a temperature of about 800° C. to about 850° C., including about 820° C., for a period of at least 8 hours. The billet is then hot worked by forging the billet into a ring-shaped preform at a temperature of about 750° C. to about 850° C. The forging can include press forging and piercing to create the ring-shaped billet.

Next, the preform is soaked at a temperature of about 815° C. to about 835° C., including about 820° C. This soaking can be done for a period of at least 2 hours, or at least 8 hours. In some particular embodiments, the preform is soaked for a period of at least 8 hours if the preform has cooled to a temperature of about 600° C. or less. The preform is then hot worked again via ring rolling the preform at a temperature of about 750° C. to about 850° C. to form a ring having a wall thickness, which desirably is substantially uniform about the circumference of the ring.

After ring rolling, the ring is air cooled. The ring is then solution annealed at a temperature of about 780° C. to about 800° C. for a period of at least 1.5 hours. Immediately following solution annealing, the ring is quenched in a quench medium (such as water). Generally, the quench medium has a maximum temperature of about 40° C. before the quenching and a maximum temperature of about 50° C. after the quenching. The ring is then age hardened by heat treating at a temperature of about 385° C. to about 400° C. for a period of about 3 hours. In particular embodiments, the about 3 hour period begins at a temperature of about 393° C., and the temperature is raised to about 400° C. The 400° C. temperature is then maintained for the remaining period of time. After heat treating, the ring is air cooled.

In some embodiments, mechanical machining can be performed on the ring to achieve a final desired shape.

The BeCu alloy used to make the metal ring has a beryllium content of from about 1.6 wt % to about 2.0 wt %, including from about 1.8 wt % to about 2.0 wt % and from about 1.6 wt % to about 1.85 wt %. In some particular embodiments, the BeCu alloy has a beryllium content of from about 1.8 wt % to about 1.9 wt %. The balance of the BeCu alloy is usually copper. In some embodiments, the BeCu alloy further comprises from about 0.2 wt % to about 0.3 wt % cobalt; or further comprises from about 0.2 wt % to about 0.6 wt % lead; or further comprises an amount of nickel, cobalt, and optionally iron such that the sum of (nickel+cobalt) is about 0.2 wt % or higher, and the sum of (nickel+cobalt+iron) is about 0.6 wt % or less.

In some embodiments, the hot working achieved by the ring rolling reduces the wall thickness by at least 50%. In further embodiments, a total reduction in wall thickness of at least 70% or greater is achieved over the entire process (i.e. all process steps).

The solution annealing can be performed for a period of about 30 minutes for approximately every 25 millimeters (mm) of wall thickness of the ring.

Disclosed in additional embodiments herein are metal rings made by the processes described above. The metal rings are made from a BeCu alloy having a beryllium content of from about 1.6 wt % to about 2.0 wt %, including from about 1.8 wt % to about 2.0 wt % and from about 1.8 wt % to about 1.9 wt %, the balance being substantially copper. The BeCu metal rings further have a 0.2% offset yield strength of at least 760 MPa; a Rockwell C hardness of at least 27 HRC; a percent elongation of at least 6%; an electrical conductivity of at least 25% IACS; and/or an average grain size of less than 0.1 mm.

These and other non-limiting characteristics of the disclosure are more particularly disclosed below

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
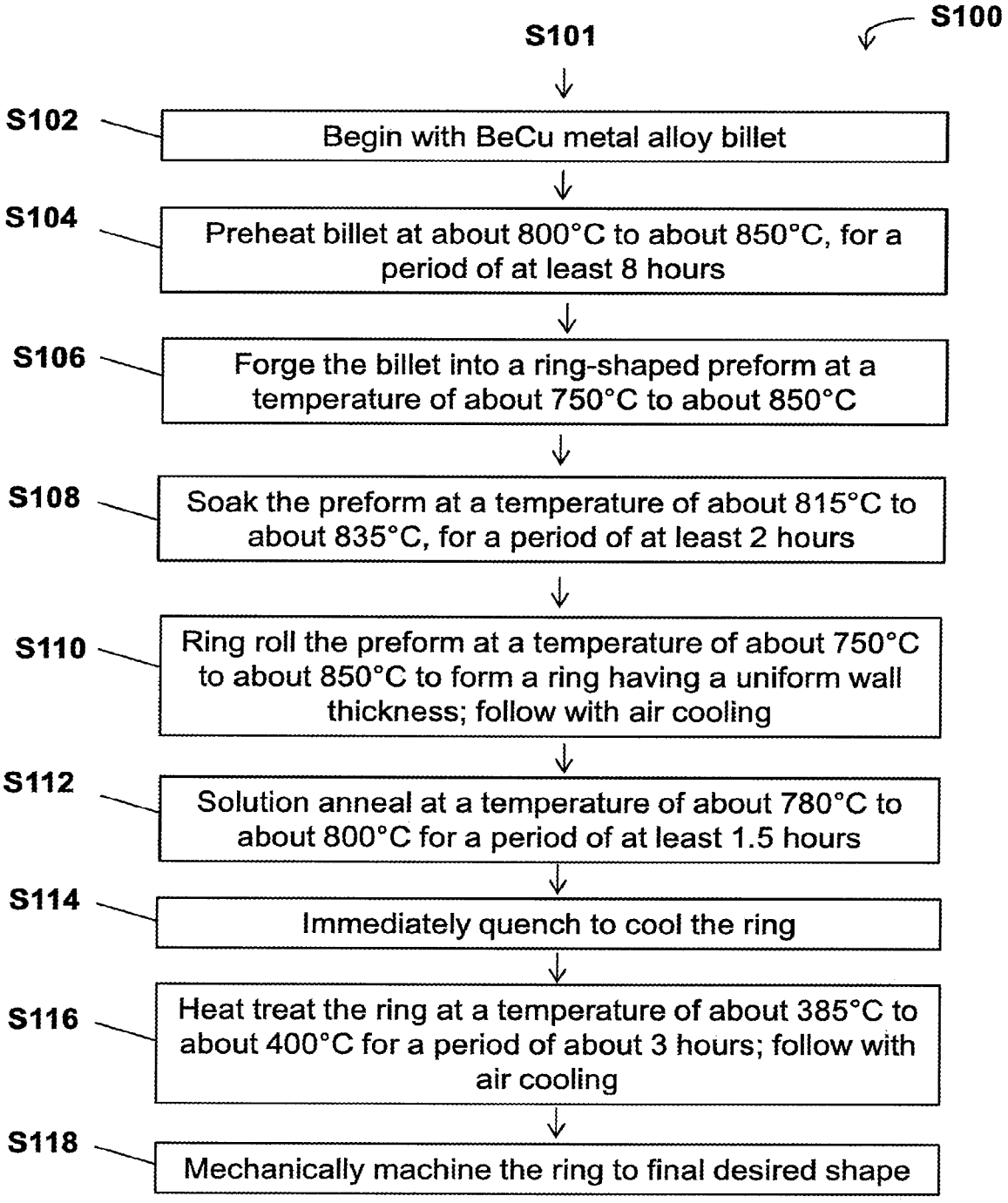
FIG. 1 is a flow chart for a first exemplary process of making a metal ring from a beryllium-copper ("BeCu") alloy including various heat treating and cooling steps.

A more complete understanding of the components and processes disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, along with any impurities that might result therefrom, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The present disclosure refers to steps for processing a metal alloy/article which occur at specified temperatures. It is noted that the temperatures referred to herein are the temperature of the atmosphere to which the metal alloy is exposed, i.e. the temperature to which the heating device (e.g. a furnace) is set. The metal alloy itself does not necessarily reach these temperatures.

The present disclosure refers to a "uniform" wall thickness. This term permits the wall thickness to vary, and should be understood to include numerical values which are the same when reduced to the same number of significant figures and numerical values which differ from the stated value by less than the experimental error of conventional measurement techniques.

Metal rims or rings are used in processes and equipment related to industrial machinery, wind power plants, high-power gears, offshore technology, rings and supporting rings for slewing bearings, turbines, generators, transformers, hydraulic motors, valves, pipelines, textile machinery, tanks/pressure vessels, gear rings, aerospace and spaceflight, bulk-feed presses, steel mills, including but not limited to use for bearings, clutches, couplings, drives, flanges, etc. However, conventional rings wear quickly, which increases the number of rings that need to be purchased each year.

The beryllium-copper rings disclosed herein are produced by novel heat treatment processes which impart material properties that allow the surface of the ring to achieve more stability for a longer period of time and allow more metal to be cast across the ring before having to re-machine to surface or purchase a replacement ring. In particular, the presently disclosed metal rings are made from a beryllium-copper ("BeCu") alloy which provides a combination of properties amenable to enhancement by the heat treatment and quench/cooling cycles described in further detail below. Such enhanced properties include but are not limited to yield strength, hardness, ductility, electrical conductivity, fine and uniform grain structure, and ultrasonic inspectability. The fine and uniform grain structure and maximum conductivity are produced by over-aging and excessive solution annealing followed by cascading over-aging process steps.

With reference to FIG. 1, an exemplary process (S100) of making a metal ring including various heat treatment and quenching/cooling cycles according to a first embodiment starts at S101. At S102, a BeCu metal alloy billet is provided or received. At S104, the billet is preheated at a temperature of about 800° C. to about 850° C., including about 820° C., for a period of at least 8 hours. This preheating step is intended to obtain as uniform a temperature as possible throughout the thickness of the billet, so that the subsequent step uniformly affects all of the metal alloy in the billet.

At S106, the billet is hot worked into a ring-shaped preform. In particular, the billet is forged into the ring-shaped preform. Hot working is a metal forming process in which the cross-section of the alloy is reduced to make the desired shape and dimension, at a temperature generally above the recrystallization temperature of the alloy. This generally reduces directionality in mechanical properties, and produces a new equiaxed microstructure.

Forging is a process by which workpiece thickness is compressed by application of heat and pressure, which expands its cross section or otherwise changes its shape. This plastically deforms the alloy, and is generally performed above the recrystallization temperature. This improves mechanical properties, improves ductility, further homogenizes the alloy, and refines coarse grains.

During forging, the hot work must generally be maintained within a controlled temperature range to avoid forging defects. For example, excessively high temperatures may result in incipient melting, and excessively low temperatures may result in surface cracking. In any event, the forging temperature should be high enough to allow recrystallization without promoting excess microstructural grain growth. Accordingly, the hot working of S106 is performed at a temperature of about 750° C. to about 850° C. Preferably, a temperature of about 770° C. to about 834° C. is maintained during hot working.

This first hot working step can be performed by various forging steps, including but not limited to press forging and piercing. Press forging refers to the slow and continuous application of pressure on the BeCu billet. In particular, press forging generally includes upsetting of the BeCu billet, where pressure acts on the longitudinal axis of the billet, causing the billet to form into a pancake shape. Upsetting also results in directional grain flow within the billet. During piercing, a hole is cut in the middle of the BeCu billet that has been flattened during press forging. As a result of piercing, the BeCu billet is transformed into a ring-shaped preform, wherein the ring shape is generally toroidal or "doughnut-like." Punching can optionally be performed in place of or in combination with piercing, where a punch removes a slug from the middle portion of the BeCu billet.

At S108, the preform is soaked at a temperature of about 815° C. to about 835° C., including about 820° C. Again, this is intended to obtain as uniform a temperature as possible throughout the thickness of the billet for subsequent processing. This soaking generally occurs for at least 2 hours, and in some embodiments may occur for at least 8 hours. In particular embodiments, the soaking occurs for a period of about 2 hours to about 8 hours.

At S110, ring rolling is performed on the preform at a temperature of about 750° C. to about 850° C. to form a ring having a uniform wall thickness, followed by air cooling. The temperature should be maintained during the entire ring rolling step. The ring rolling is preferably performed at a temperature of about 770° C. to about 834° C. The ring rolling reduces the wall thickness by at least 50%. In other words, the hot work forging performed on the ring-shaped preform generally reduces the area of the casting by at least 50%.

Following the ring rolling, the ring is air cooled. In this regard, the BeCu ring is removed from the furnace and exposed to ambient temperature. If desired, air cooling can be active, i.e. ambient air is blown towards the ring.

At S112, the ring is solution annealed at a temperature of about 780° C. to about 800° C. for a period of at least 1.5 hours. In general, the solution annealing of S112 should be performed for a period of about 30 minutes for approximately every 25 mm of ring wall thickness.

The solution annealing is immediately followed by quenching the ring in a quench medium at S114. The quench medium should have a maximum temperature of about 40° C. before the quenching and a maximum temperature of about 50° C. after the quenching. This type of quenching quickly changes the temperature of the BeCu ring, and generally results in a single phase.

At S116, the ring is age hardened by heat treating at a temperature of about 385° C. to about 400° C. for a period of about 3 hours, followed by air cooling. Mechanical machining of the ring can optionally be performed at S118. As a result of these steps, a BeCu metal ring with a fine uniform grain size is formed.

Figure 2:
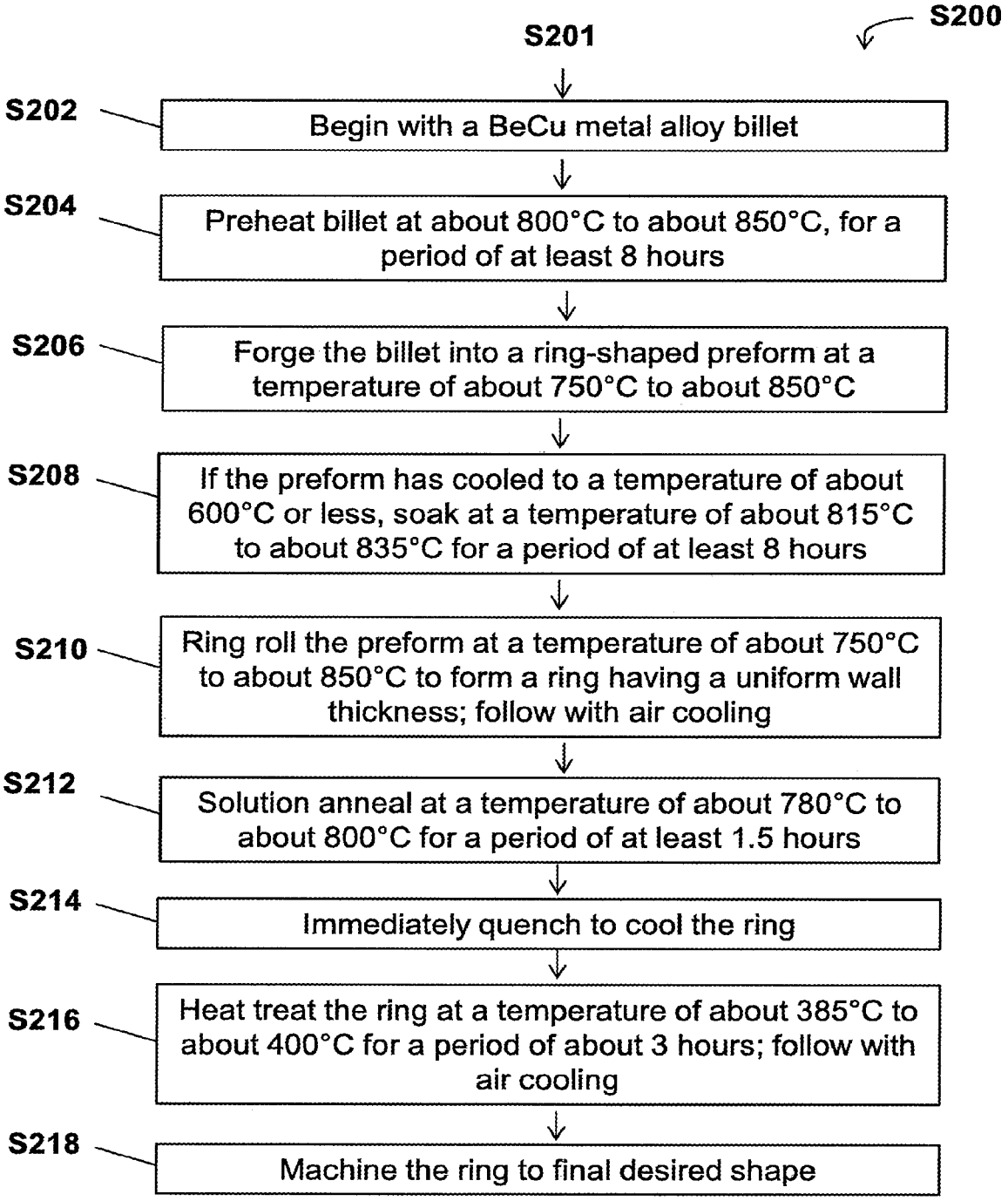
FIG. 2 is a flow chart for a second exemplary process of making a metal ring from a BeCu alloy including various heat treating and cooling steps.

With reference to FIG. 2, another exemplary process (S200) of making a metal ring according to a second embodiment starts at S201. At S202 a BeCu metal alloy billet is provided. At S204, the billet is preheated at a temperature of about 800° C. to about 850° C., including about 820° C., for a period of at least 8 hours. At S206, the billet is hot worked into a ring-shaped preform. Again, the hot work must generally be maintained within a controlled temperature range to avoid forging defects as discussed above. Accordingly, the billet is forged into the ring-shaped preform at a temperature of about 750° C. to about 850° C. Preferably, a temperature of about 770° C. to about 834° C. is maintained during hot working.

At S208, if the preform has cooled to a temperature of about 600° C. or less, the preform is soaked at a temperature of about 815° C. to about 835° C., including about 820° C., for a period of about 8 hours, including at least 8 hours. At S210, ring rolling is performed on the preform at a temperature of about 750° C. to about 850° C. to form a ring having a uniform wall thickness, followed by air cooling. Again, the ring rolling is preferably performed at a temperature of about 770° C. to about 834° C. At S212, the ring is solution annealed at a temperature of about 780° C. to about 800° C. for a period of at least 1.5 hours. In general, the solution annealing of S212 is performed for a period of about 30 minutes for approximately every 25 mm of ring wall thickness.

The solution annealing is immediately followed by quenching the ring in a quench medium at S214. The quench medium is usually water. The quench medium should have a maximum temperature of about 40° C. before the quenching and a maximum temperature of about 50° C. after the quenching.

At S216, the ring is age hardened by heat treating at a temperature of about 385° C. to about 400° C. for a period of about 3 hours, followed by air cooling. Mechanical machining of the ring can optionally be performed at S218. A BeCu amorphous metal ring with a fine uniform grain size is formed.

In particular embodiments illustrated by FIG. 1 and FIG. 2, during the heat treating step (S116, S216), the about 3 hour period begins at a temperature of about 393° C. The temperature is raised to about 400° C., and the temperature is maintained at this temperature for the remaining period of time.

More generally, the processes illustrated in FIG. 1 and FIG. 2 are related to making a BeCu ring having a fine uniform grain size. A raw BeCu casting is pre-forged and turned into a billet from which the ring is made. The BeCu metal alloy billet is provided (S102, S202). The billet is preheated to a first temperature of from about 800° C. to about 850° C., including about 820° C., for a first time period of at least 8 hours (S104, S204). A first hot work forging of the billet is performed to create a ring-shaped preform (S106, S206). The ring-shaped preform is then soaked at a second temperature of from about 815° C. to about 835° C. for a second time period of at least 2 hours (S108, S208). A second hot work forging is performed by ring rolling, followed by air cooling, to form a ring having a uniform wall thickness (S110, S210). The ring is then exposed to a third temperature of from about 780° C. to about 800° C. for a third time period (S112, S212). Immediately after the third temperature and third time period, the ring is cooled by quenching (S114, S214). The ring is then heated to a fourth temperature which is less than the first, second, and third temperatures and for a fourth time period, followed by air cooling to a final ambient temperature to produce the ring (S116, S216) with a fine uniform grain size. If desired, mechanical machining can be performed on the ring at (S118, S218). Mechanical machining may include but is not limited to sawing, drilling, tapping, boring, milling, turning, grinding, burnishing, reaming, electrical discharge machining ("EDM") etc., in order to achieve a desired final shape for the BeCu metal ring. The final shape of the BeCu metal ring may be based on the application in which the ring is used.

The processes illustrated in FIG. 1 and FIG. 2 generally result in a total reduction in wall thickness of at least 70%. In general, the reduction ratio for the BeCu ring-shaped preform should be large enough to allow the deformation to penetrate the entire work section. Partial penetration, particularly on the final passes of ring rolling, will not produce the desired uniform dynamic recrystallization in the BeCu ring. Insufficient deformation may result in nonuniformity in microstructure and mechanical properties after the age hardening in process steps (S116, S216).

The degree of reduction can be determined by measuring the change in the cross-sectional area of the ring wall before and after hot ring rolling, or before preheating and after heat treating or optional finishing, according to the following formula:

$$\% \text{ HW}=100*[A_0-A_f]/A_0$$

where $A_0$ is the initial or original cross-sectional area before hot working, and $A_f$ is the final cross-sectional area after hot working. It is noted that the change in cross-sectional area is usually due solely to changes in the thickness of the alloy, so the % HW can also be calculated using the initial and final thickness as well.

Furnaces used in the heat treatment processes described herein preferably meet the requirements of AMS2750 or the NORSOK equivalent for pyrometry. The solution annealing of process steps (S112, S212) are preferably performed in a Class 5 furnace, and more preferably in a Class 2 furnace. The age hardening or heat treating steps of (S116, S216) are preferably performed in a Class 2 furnace. Furnace class definitions are delineated in AMS2750 or the NORSOK equivalent.

Figure 3:
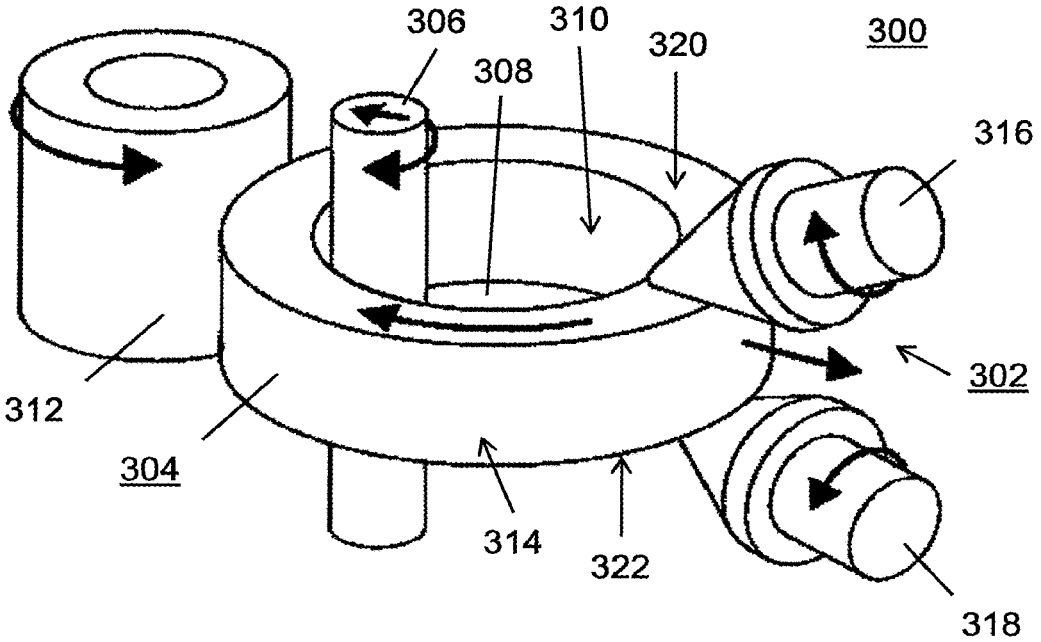
FIG. 3 is an illustration of a rolling operation which utilizes an exemplary ring rolling mill used to form the BeCu metal rings disclosed herein.

In both embodiments illustrated by FIG. 1 and FIG. 2, the second hot work forging (S110, S210) is generally performed by ring rolling on a rolling mill. An exemplary ring rolling operation 300 including ring rolling mill 302 is illustrated in FIG. 3. During ring rolling, the BeCu ring-shaped preform 304 is placed over an idler roll 306. The idler roll 306 is generally disposed within the hollow central portion 308 of the ring-shaped preform 304 and acts against an inner surface 310 or diameter thereof. A drive roll 312 is generally disposed against an outer surface 314 or diameter of the ring-shaped preform. An upper axial roller 316 is disposed against a top surface 320 of the preform. A lower axial roller 318 is disposed against a bottom surface 322 of the preform.

Pressure is continuously applied to the preform 304 by the idler roll 306, the drive roll 312, the upper axial roller 316, and the lower axial roller 318. The pressure is continuously applied until the desired inner diameter, outer diameter, height, and/or wall thickness of the ring is achieved. Generally, the ring rolling is performed with the goal of thoroughly working the ring cross-section as uniformly as practical to minimize grain size differences after recrystallization. An average grain size of less than about 0.1 mm is desirable.

Figure 4:
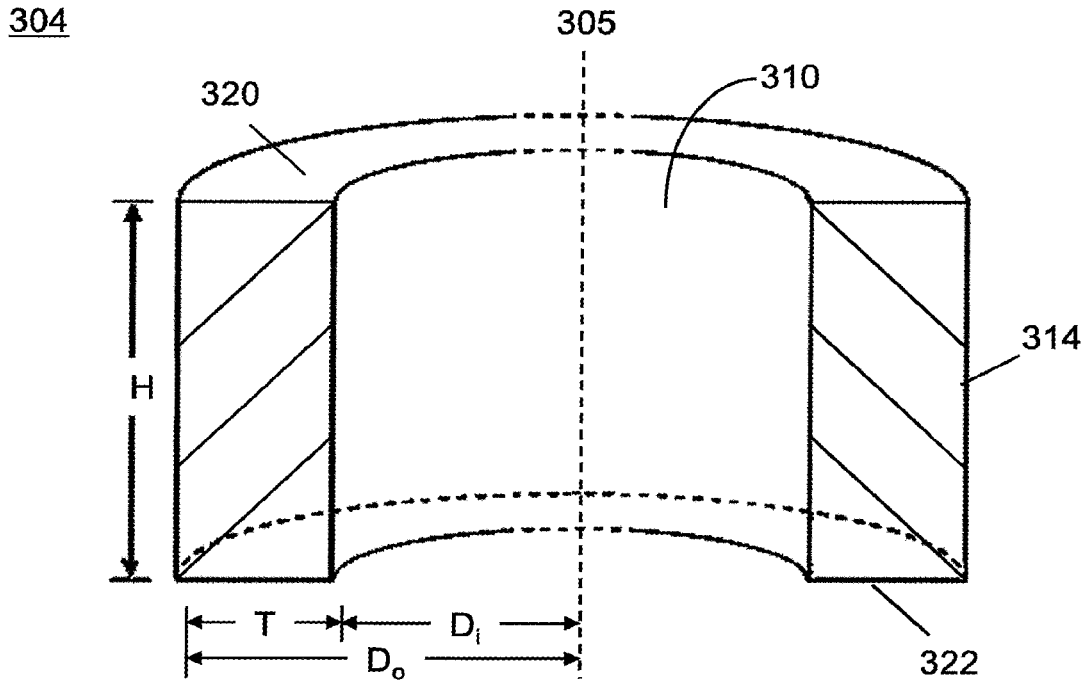
FIG. 4 is a cross-section view of an exemplary BeCu metal ring preform formed by the processes disclosed herein.

FIG. 4 is a cross-sectional view of the preform 304, which can also represent the finished ring. The preform has an inner diameter $D_i$ and an outer diameter $D_o$. The wall thickness T of the ring is the difference between the two diameters. The ring also has a height H. The diameters are measured from center axis 305.

In some embodiments, the BeCu ring may have an outer diameter $D_o$ of from about 250 mm to about 8,000 mm, including from about 350 mm to about 2,000 mm. The inner diameter $D_i$ of the BeCu ring may be at least about 150 mm to about 350 mm. The BeCu ring generally has a wall thickness T of less than about 700 mm to about 800 mm. The height H of the BeCu ring is generally from about 20 mm to about 900 mm, including from about 200 mm to about 300 mm.

The inner surface 310 is generally smooth. The outer surface 314, the upper surface 320, and the lower surface 322 are shown as being flat, though they can be shaped as desired for the application/device for which the ring is to be used.

As a result of the exemplary process steps described above, a metal ring made of BeCu is formed having a variety of advantageous properties. These advantageous properties include but are not limited to strength, hardness, ductility, electrical conductivity, and refined grain size. In particular, the advantageous properties include any combination of a 0.2% offset yield strength of at least 760 MPa; a Rockwell C hardness of about 27 HRC to about 33 HRC; a percent elongation of at least 6%; an electrical conductivity of at least 25% of the International Annealed Copper Standard ("IACS", where 100% IACS is equal to $5.8\times10^7$ Siemens/meter or 1.72 micro-ohm-cm); and an average grain size of less than 0.1 mm. The average grain size is measured in the axial direction on a slice taken from the rolled ring and on the inside face of the slice closest to the finished part. The 0.2% offset yield strength is measured according to ASM E8. The Rockwell C hardness is measured according to ASTM E18. The % elongation is measured according to ASTM E3. The electrical conductivity is measured according to ASTM E1004.

The BeCu alloy used to form the metal ring comprises about 1.6 wt % to about 2.0 wt % beryllium, including from about 1.8 wt % to about 2.0 wt % and from about 1.8 wt % to about 1.9 wt % beryllium.

The BeCu alloy can also include small amounts of cobalt (Co), nickel (Ni), iron (Fe), and/or lead (Pb). In some embodiments, the BeCu alloy may further comprise from about 0.2 wt % to about 0.3 wt % cobalt. In still other embodiments, from about 0.2 wt % to about 0.6 wt % lead may be included in the BeCu alloy.

In other embodiments, the sum of cobalt and nickel in the BeCu alloy is at least 0.2 wt %. In other embodiments, the sum of cobalt, nickel, and iron in the BeCu alloy is at most 0.6 wt %. It should be noted that this does not require all three elements to be present. Such alloys could contain at least one of nickel or cobalt, but could potentially contain only nickel or cobalt. The presence of iron is not required, but in some particular embodiments iron is present in an amount of about 0.1 wt % or more (up to the stated limit).

In some particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 25. Alloy 25 has an elastic modulus of about 131 GPa; density of about 8.36 g/cc; a thermal conductivity at 25° C. of about 105 W/(m·K); 0.2% offset yield strength of about 130 MPa to about 280 MPa before heat treatment; minimum ultimate tensile strength of about 410 MPa before heat treatment; and minimum 35% elongation before heat treatment.

In some particular embodiments, the BeCu alloy comprises about 1.6 wt % to about 1.85 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 165. Alloy 165 has an elastic modulus of about 131 GPa; density of about 8.41 g/cc; a thermal conductivity at 25° C. of about 105 W/(m·K); 0.2% offset yield strength of about 130 MPa to about 280 MPa before heat treatment; minimum ultimate tensile strength of about 410 MPa before heat treatment; and minimum 35% elongation before heat treatment.

In other embodiments, the BeCu alloy comprises about 1.6 wt % to about 2.0 wt % beryllium; about 0.2 wt % to about 0.3 wt % cobalt; and balance copper. This alloy is commercially available from Materion Corporation as MoldMax HH® or MoldMax LH®.

MoldMax HH® has an elastic modulus of about 131 GPa; density of about 8.36 g/cc; and thermal conductivity at 25° C. of about 130 W/(m·K); 0.2% offset yield strength of about 1000 MPa; a typical ultimate tensile strength of about 1170 MPa; and a typical 5% elongation.

MoldMax LH® has an elastic modulus of about 131 GPa; density of about 8.36 g/cc; and thermal conductivity at 25° C. of about 155 W/(m·K); 0.2% offset yield strength of about 760 MPa; a typical ultimate tensile strength of about 965 MPa; and a typical 15% elongation.

In other particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; from about 0.2 wt % to about 0.6 wt % lead; and balance copper. This alloy is commercially available from Materion Corporation as Alloy M25. Alloy M25 has an elastic modulus of about 131 GPa; density of about 8.36 g/cc; a thermal conductivity at 25° C. of about 105 W/(m·K); 0.2% offset yield strength of about 130 MPa to about 250 MPa before heat treatment; minimum ultimate tensile strength of about 410 MPa before heat treatment; and minimum 20% elongation before heat treatment.

In some particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 190. Alloy 190 has an elastic modulus of about 131 GPa; density of about 8.36 g/cc; and a thermal conductivity at 25° C. of about 105 W/(m·K).

In some particular embodiments, the BeCu alloy comprises about 1.8 wt % to about 2.0 wt % beryllium; a sum of cobalt and nickel of at least 0.2 wt %; a sum of cobalt, nickel, and iron of at most 0.6 wt %; and balance copper. This alloy is commercially available from Materion Corporation as Alloy 290. Alloy 290 has an elastic modulus of about 131 GPa; density of about 8.36 g/cc; and a thermal conductivity at 25° C. of about 105 W/(m·K).

As briefly mentioned above, one benefit to using BeCu alloys for the rings of the present disclosure is the ability to perform ultrasonic inspection. Ultrasonic inspection is a useful and versatile non-destructive testing technique which an be used for flaw detection/evaluation, dimensional measurements, material characterization, and more. Ultrasonic testing is generally performed according to AMS 2154 Type I and Class A or EN 10228-4, Class 3 equivalent. Depending on the size of the BeCu ring, it may be necessary to pre-machine the ring prior to ultrasonic inspection to provide a better surface finish for to ultrasonic inspection and allow for any movement of the ring prior to finish machining.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A process for making a metal ring from a BeCu alloy, comprising:

preheating a BeCu alloy billet at a temperature of about 800° C. to about 850° C., wherein the BeCu alloy comprises about 1.6 wt % to about 2.0 wt % beryllium;

forging the billet into a ring-shaped preform at a temperature of about 750° C. to about 850° C.;

soaking the preform at a temperature of about 815° C. to about 835° C.;

ring rolling the preform at a temperature of about 750° C. to about 850° C. to form a ring having a wall thickness, wherein the ring rolling reduces the wall thickness by at least 50%;

solution annealing the ring at a temperature of about 780° C. to about 800° C., immediately followed by quenching the ring, wherein the solution annealing is performed for a period of about 30 minutes for approximately every 25 mm of wall thickness of the ring; and heat treating the ring at a temperature of about 385° C. to about 400° C.

2. The process of claim 1, wherein the preheating occurs for a period of at least 8 hours.

3. The process of claim 1, wherein the soaking occurs for a minimum period of 2 hours.

4. The process of claim 3, wherein the soaking is performed for a period of at least 8 hours if the preform has cooled to a temperature of about 600° C. or less.

5. The process of claim 1, wherein the solution annealing occurs for a period of at least 1.5 hours.

6. The process of claim 1, wherein the heat treating occurs for a period of about 3 hours.

7. The process of claim 6, further comprising starting the about 3 hour period at a temperature of about 393° C., raising the temperature to about 400° C., and heat treating the ring at the about 400° C. temperature for the remaining period of time.

8. The process of claim 1, wherein the preheating and soaking are each performed at a temperature of about 820° C.

9. The process of claim 1, wherein the ring rolling reduces the wall thickness by at least 70%.

10. The process of claim 1, further comprising air cooling the ring after both the ring rolling and the heat treating.

11. A process for making a metal ring comprising:

providing a billet made from a BeCu alloy comprising about 1.6 wt % to about 2.0 wt % beryllium;

preheating the billet at a temperature of about 800° C. to about 850° C. for a period of at least 8 hours;

forming a ring-shaped preform from the billet at a temperature of about 750° C. to about 850° C.;

soaking the preform at a temperature of about 815° C. to about 835° C. for a period of about 2 hours to about 8 hours;

ring rolling the preform at a temperature of about 750° C. to about 850° C. until the preform has a substantially uniform wall thickness, followed by air cooling;

solution annealing the preform at a temperature of about 780° C. to about 800° C. for a period of at least 1.5 hours, immediately followed by quenching in a quench medium, wherein the solution annealing is performed for a period of about 30 minutes for approximately every 25 mm of wall thickness of the ring;

heat treating the preform at a temperature of about 385° C. to about 400° C. for a period of about 3 hours, followed by air cooling; and, mechanically machining the preform to form the metal ring having a desired shape.

12. The process of claim 11, wherein the BeCu alloy billet comprises from about 1.8 wt % to about 2.0 wt % beryllium.

13. The process of claim 11, wherein the BeCu alloy billet further comprises from about 0.2 wt % to about 0.3 wt % cobalt.

14. The process of claim 11, wherein the BeCu alloy billet comprises:

about 1.8 wt % to about 2.0 wt % beryllium;

an amount of nickel, cobalt, and optionally iron such that the sum of (nickel+cobalt) is about 0.2 wt % or higher, and the sum of (nickel+cobalt+iron) is about 0.6 wt % or less;

about 0.2 wt % to about 0.6 wt % lead; and balance copper.

15. The process of claim 1, wherein the BeCu alloy billet comprises from about 1.8 wt % to about 2.0 wt % beryllium.

16. The process of claim 1, wherein the BeCu alloy billet further comprises from about 0.2 wt % to about 0.3 wt % cobalt.

17. The process of claim 1, wherein the BeCu alloy billet comprises:

about 1.8 wt % to about 2.0 wt % beryllium;

an amount of nickel, cobalt, and optionally iron such that the sum of (nickel+cobalt) is about 0.2 wt % or higher, and the sum of (nickel+cobalt+iron) is about 0.6 wt % or less;

about 0.2 wt % to about 0.6 wt % lead; and balance copper.

18. The process of claim 1, wherein the BeCu alloy billet comprises:

about 1.6 wt % to about 2.0 wt % beryllium;

about 0.2 wt % to about 0.3 wt % cobalt; and balance copper.

19. The process of claim 1, wherein the BeCu alloy billet comprises:

about 1.8 wt % to about 2.0 wt % beryllium;

an amount of nickel, cobalt, and optionally iron such that the sum of (nickel+cobalt) is about 0.2 wt % or higher, and the sum of (nickel+cobalt+iron) is about 0.6 wt % or less; and balance copper.

* * * * *